United States Patent [19]

Morris et al.

[11] 4,163,546

[45] * Aug. 7, 1979

[54] APPARATUS FOR APPLYING GRANULAR REFRACTORY MATERIAL TO SURFACES

[76] Inventors: John C. Morris, 3573 Riverbend Rd., Birmingham, Ala. 35243; James K. Weidman, 212 Azalea Dr., Gadsden, Ala. 35901; Michael D. Prior, P.O. Box 139, Smith Cir., Pell City, Ala. 35125

[ * ] Notice: The portion of the term of this patent subsequent to Jul. 11, 1995, has been disclaimed.

[21] Appl. No.: 883,731

[22] Filed: Mar. 6, 1978

[51] Int. Cl.[2] ..... B05B 3/00

[52] U.S. Cl. ..... 266/281; 239/227

[58] Field of Search ..... 239/227; 266/281, 287

[56] References Cited

U.S. PATENT DOCUMENTS

| | | | |
|---|---|---|---|
| 691,419 | 1/1902 | Vandervoort | 239/227 |
| 4,099,708 | 7/1978 | Morris et al. | 266/281 |

*Primary Examiner*—Gerald A. Dost

[57] ABSTRACT

Our improved nozzle mounting comprises a support member for the nozzle secured to the projecting end of the innermost or granular material carrying conduit. The nozzle is mounted on a horizontally disposed pivot, carried by said support member. Granular material is conveyed from the lower end of the granular conveying pipe to the nozzle through a flexible member and water is supplied to the mixing nozzle by means of a flexible water pipe or hose. Our improved mixing nozzle mounting is simpler in construction than the one shown in our aforesaid patent and hence is cheaper to construct and maintain inasmuch as we have eliminated various rotary seals, gears and the like.

3 Claims, 4 Drawing Figures

APPARATUS FOR APPLYING GRANULAR REFRACTORY MATERIAL TO SURFACES

REFERENCE TO PRIOR PATENT

This invention relates to an improvement upon a portion of the apparatus shown, described and claimed in our U.S. Pat. No. 4,099,708, dated July 11, 1978, "APPARATUS FOR APPLYING GRANULAR REFRACTORY MATERIAL TO SURFACES".

Reference to the above identified patent will disclose apparatus useful for renewing or prolonging the life of the linings of ladles, furnaces, and other open top vessels used in the handling of molten metals. The aforesaid patent discloses generally a pair of telescopically arranged conduits both mounted for simultaneous 360° rotation. Means is provided to feed granular material into the upper end of the innermost of said conduits and water is supplied to the upper end of the outermost one thereof. The granular material is fed into the nozzle in dry form and is mixed with water in the nozzle. Means is shown in said patent also for rotating the nozzles and for moving the nozzle up and down. We hereby incorporate the aforesaid patent by reference herein as if the same were fully set forth.

Our present invention relates to an improvement in the means for mounting the mixing nozzle and for supplying the granular material and water thereto.

Our invention contemplates a construction of the character designated in which the nozzle is mounted for pivotal movement on a simple, generally horizontally disposed pivot, which pivot is carried adjacent the lower end of a bracket which depends from the lower, projecting end of the inner or granular material carrying conduit. Our invention contemplates supplying the granular material and the water to the nozzle by means of flexible conduits. The means shown in the aforesaid patent for raising and lowering the nozzle shown therein is employed in our present invention to move the nozzle vertically throughout an arc of substantially 90° by simply pivoting the same on its mounting.

Apparatus illustrating features of our invention is shown in the accompanying drawings forming a part of this application in which.

Figure 1:
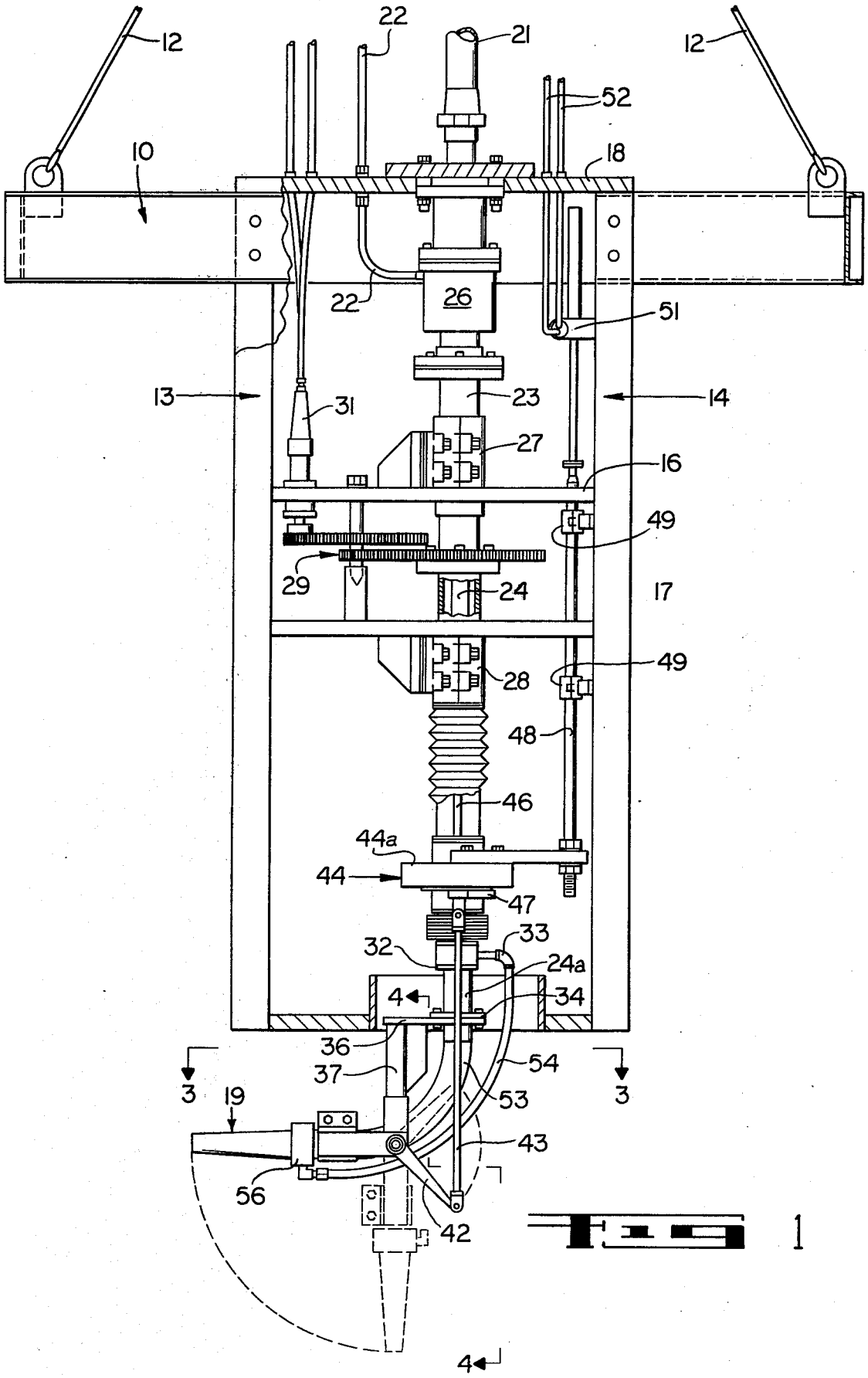
FIG. 1 is an enlarged fragmental detail view of our improved apparatus, certain parts being broken away and in section and showing our improved nozzle mounting means.
Figure 2:
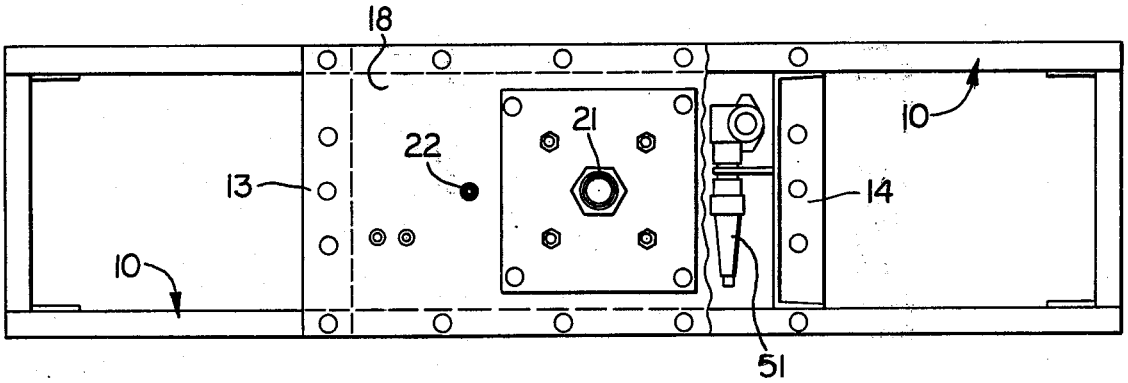
FIG. 2 is a plan view with certain parts broken away and in section.
Figure 3:
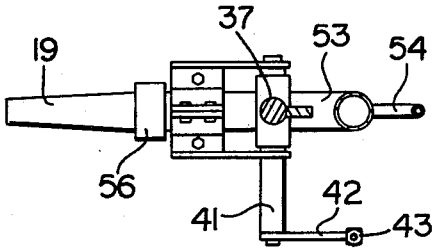
FIG. 3 is a detail fragmental view taken generally along line 3—3 of FIG. 1; and, FIG. 4 is a detail fragmental sectional view taken generally along line 4—4 of FIG. 1.
Figure 4:
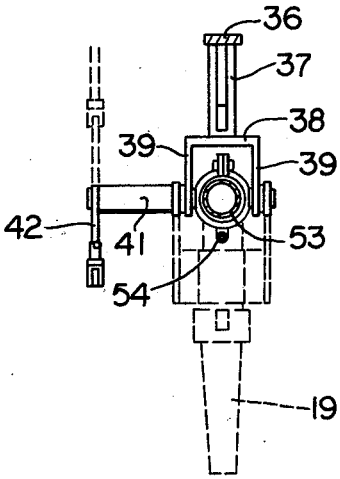

Referring now to the drawings for a better understanding of our invention as disclosed in said patent our invention comprises generally a cross frame member 10 which is adapted to be suspended in position over a ladle, furnace, or the like, by means of cables 12 or the like. The cables 12 may be connected to an overhead crane of appropriate size and capacity so that the lower end of our apparatus which carries the nozzle may be placed in a ladle, furnace or the like and raised and lowered relative thereto so that the entire bottom and side walls may be coated with the refractory as will presently appear.

In FIG. 1 of the drawings we have removed most of the cover plates to expose the operative parts of the apparatus. As shown, our apparatus comprises depending frame members 13 and 14 which are held in spaced relation by means of a number of plates 16, 17 and 18. The entire apparatus is suspended from the beams 10 by securing the plate 18 to the beams.

At the lower end of the vertical framework we show a mixing nozzle 19 to which the granular material in dry form is supplied through a conduit from a suitable supply 21 and also to which water is supplied through a conduit 22, all as will be explained more in detail. Suffice it here to say that the dry material supplied through the conduit 22 finally reach the nozzle 19 as will be explained. It will be understood that the granular material is supplied in an airborne stream, under pressure, usually on the order of fifty to sixty pounds per square inch and that the water is likewise supplied under some pressure, for instance, up to sixty pounds per square inch. Therefore, the nozzle 19 delivers moistened granular material which may be applied to all areas of an existing lining in a vessel, thus to repair it or to coat it, thereby to prolong its life.

It will be understood that the outer conduit 23 and the inner conduit 24 are telescopically related. A rotary seal unit 26 delivers water from the supply pipe 22 into the upper, open end of the outer conduit 23. The outer conduit is supported in bearings 27 and 28 carried by the framework. Through a series of gears indicated at 29 an air motor 31 rotates the outer conduit and hence the inner conduit. It will be understood that a plate 32 on the lower end of the outer conduit 23 makes the two conduits water-tight so that water may be drawn from the lower end of conduit 23 through a fitting 33 to be supplied to the nozzle as will be later explained.

Suffice it here to say that in operation granular material may be fed from the supply pipe 21 so that it passes down the inner conduit 24. Simultaneously water is supplied through line 22 to the upper open end of the outer conduit 23 so that it passes down conduit 23. Energization of the motor 31 rotates both conduits simultaneously through the gears 29.

Our improvement comprises in part mounting on the lower projecting end **24*a* of the inner conduit 24 a support bracket for the nozzle. Thus, a collar 34 surrounds the end 24*a* of the inner conduit. Projecting outwardly from this collar is a horizontal plate 36. Depending from the plate 36 is a member 37. Secured to the lower end of the member 37 is an inverted yoke member 38, the legs 39 of which carry aligned pivot points for the nozzle. Thus, the nozzle is mounted on a substantially horizontally disposed pivot so that it may move from the full line to dotted line positions shown in FIG. 1**.

Extending outwardly from one of the legs 39 is a shaft 41. Connected to the shaft 41 is an arm 42. This arm is connected to a push-pull arm 43 in turn connected to a mechanism 44 which surrounds the outer conduit 23. The mechanism 44 is slidably connected about the conduit. The upper part **44*a* of the same is mounted so that the conduit 23 is free to rotate relative thereto. However, a lower part of the mechanism 44 indicated at 47 to which the upper end of the push-pull link 43 is connected, while free to move up and down, is slidably mounted on a key 46 fixed to conduit 23**.

Another push-pull arm 48 is mounted in suitable bearings 49 and extends upwardly where it is operatively connected to a hydraulic motor 51. Air lines 52 supply air under pressure to the motor 51. Therefore, when motor 51 is operated push-pull rod 48 moves up and down, in turn sliding the unit 44 on the outer conduit 23, thus to pivot the nozzle about its pivot point while permitting conduit 23 to rotate substantially 360°.

At 53 we show a flexible hose which connects the lower end of the inner conduit 24 to the entrance end of the nozzle, thus to supply dry granular material to the nozzle. At 54 we show a flexible hose connected to the fitting 33 and to the mixing section 56 of the nozzle 19 so that water from the outer conduit is supplied to the nozzle.

Insofar as the various details of the mechanism 26 and 44 are concerned, reference is again made to said patent identified above.

With the mechanism in operation granular material is supplied from the supply pipe 21 all the way through the flexible hose 53 to the nozzle. Water is supplied from the supply pipe 22, around the inner conduit 24, inside the conduit 23, thence through the fitting 33 and flexible conduit 54 to the mixing section of the nozzle. At the same time operation of the motor 31 permits the inner and outer conduits and the section 47 of the member 44 and hence the arm 43 to rotate. Energization of the air motor 51 therefore raises the push rod 48 and thence rocks the nozzle 19 on its pivot point. The nozzle is thus free to move through an arc of substantially 90° in a vertical plane, substantially as shown in FIG. 1, and through substantially 360° in a horizontal plane. The inside of a vessel, ladle, furnace or the like may be effectively sprayed with the material by rotating the nozzle, pivoting it up and down, and simultaneously moving the entire apparatus up and down by means of a crane connected to the ropes 12.

It will be noted that our improved nozzle mounting is free of the complications of rotary stuffing boxes, gears and the like. Our improved nozzle as herein shown therefore is simpler than the one shown in our above mentioned patent although the former has been used and has proven to be satisfactory. Our invention is characterized by its simplicity and cheapness of construction and its reliability in operation.

While we have shown our invention in but one form it will be obvious to those skilled in the art that it is not so limited but is susceptible of various changes and modifications without departing from the spirit thereof.

We claim:

1. In apparatus for applying granular refractory material to the interior surfaces of an open top ladle, furnace or the like, (a) a pair of generally vertically disposed telescopically related conduits, (b) means to supply granular refractory material to the upper end of the inner one of said conduits, (c) means to supply water to the upper end of the outer one of said conduits, (d) means to support said conduits for substantially 360° simultaneous rotation, (e) said inner conduit having a lower end portion projecting past the lower end of the outer conduit, (f) a nozzle support member secured to a projecting portion of the lower end of the inner conduit, (g) a mixing nozzle mounted on the support for the discharge end thereof to move in a generally vertical plane, (h) a flexible conduit connecting the nozzle to the inner conduit, whereby the conduit may receive and discharge granular material flowing down the inner conduit, (i) means to supply water from the lower end of the outer conduit to the nozzle, and (j) power means operatively connected to the nozzle and adapted to move it in said substantially vertical plane through an axis of substantially 90°, namely, from substantially horizontal position to substantially vertical position.

2. Apparatus as defined in claim 1 in which said support for the nozzle comprises a pair of depending spaced apart members secured to a bracket which in turn is secured to the lower end of the inner conduit, and means in said depending members providing a substantially horizontal pivot on which the nozzle is mounted.

3. Apparatus as defined in claim 1 in which the means to supply water from the lower end of the outer conduit to the nozzle comprises a length of flexible conduit connecting the nozzle to the outer conduit.

* * * * *